United States Patent [19]

Staffer et al.

[11] 4,449,453

[45] May 22, 1984

[54] DEVICE FOR DRYING PRINTED SHEETS ON OFFSET PRINTING PRESSES

[75] Inventors: Julius Staffer, Mauer; Karl-Heinz Walther; Hans-Georg Jahn, both of Wiesenbach, all of Fed. Rep. of Germany

[73] Assignee: Heidelberger Druckmaschinen, Heidelberg, Fed. Rep. of Germany

[21] Appl. No.: 435,390

[22] Filed: Oct. 20, 1982

[30] Foreign Application Priority Data

Oct. 30, 1981 [DE] Fed. Rep. of Germany ..... 3143089

[51] Int. Cl.[3] ..... B41F 23/04

[52] U.S. Cl. ..... 101/416 A; 34/41; 34/155

[58] Field of Search ..... 432/59; 34/4, 155, 41; 101/416 A, 416 R, 416 B

[56] References Cited

U.S. PATENT DOCUMENTS

| | | | |
|---|---|---|---|
| 1,955,055 | 4/1934 | Date | 101/416 A X |
| 2,220,928 | 11/1940 | Kienle et al. | 101/416 A |
| 2,269,236 | 1/1942 | Wellmar | 34/41 |
| 3,499,231 | 3/1970 | Mullaney | 34/155 X |

FOREIGN PATENT DOCUMENTS

| | | | |
|---|---|---|---|
| 140272 | 1/1935 | Austria | 101/416 |
| 2351280 | 5/1975 | Fed. Rep. of Germany | 34/4 |
| 2731075 | 1/1979 | Fed. Rep. of Germany | 34/41 |
| 386840 | 1/1933 | United Kingdom | 34/41 |
| 576829 | 4/1946 | United Kingdom | 34/4 |
| 474664 | 10/1975 | U.S.S.R. | 34/4 |

*Primary Examiner*—Edgar S. Burr
*Assistant Examiner*—John A. Weresh
*Attorney, Agent, or Firm*—Herbert L. Lerner; Laurence A. Greenberg

[57] ABSTRACT

Device for drying printed sheets on an offset printing machine, including infrared radiators disposed above a delivery pile of the sheets and between an upper and a lower run of an endless delivery chain, the infrared radiators being displaceable from a rest position into a working position thereof directly above the sheets, and means for replacing the infrared radiators with blowers for changing the mode of operation of the device.

6 Claims, 3 Drawing Figures

DEVICE FOR DRYING PRINTED SHEETS ON OFFSET PRINTING PRESSES

SPECIFICATION

The invention relates to a device for drying printed sheets on offset printing presses and, more particularly, by means of infrared radiators and blowers which are disposed above a delivery pile.

A drier using radiators has become known heretofore (Elektro-Anzeiger, Essen, No. 4-24 January 1953, Page 34, FIG. 7) wherein the radiators are disposed at a great distance above the delivery system of a high-speed press. Due to the high energy losses, this system only achieves an hourly output of 2000 sheets. Thus, the aforementioned heretofore known infrared drier in no way meets present-day requirements.

A further device of this type (Japanese Patent No. Sho 52-56615) shows an embodiment of an infrared drier which is likewise disposed above a delivery pile. Both runs of the delivery chain pass between the pile and the infrared radiators so that there is a large spacing between the surface of the pile i.e. between the last fed sheet, and the radiators, and, thereby, a high power output for the radiators themselves is required. The heat loss caused by the large spacing not only heats the mechanical parts in the delivery system, such as the delivery chain with the gripper bars, but also discharges a large quantity of heat unused into the environment. This heretofore known embodiment is not only very extensive and expensive in the construction thereof, but also exhibits considerable energy losses which directly cause an increase in the cost of production.

It is an object of the invention to provide an infrared drying device for high-speed offset printing presses which, with minimum technical outlay, enables efficient drying of the variously printed materials in vicinity of the sheet delivery requiring as little energy as possible, has heat losses which are optimally low and which can, in a simple manner, be adapted to the respective drying conditions and modes of operation.

With the foregoing and other objects in view, there is provided, in accordance with the invention, a device for drying printed sheets on an offset printing machine including infrared radiators disposed above a delivery pile of the sheets and between an upper and a lower run of an endless delivery chain, the infrared radiators being displaceable from a rest position into a working position thereof directly above the sheets, and means for replacing the infrared radiators with blowers for changing the mode of operation of the device.

An essential advantage of the device according to the invention is that the infrared radiators are disposed directly above the delivery pile so that this measure alone makes it possible to cut the heating capacity or power approximately in half for the same drying capacity of power at the sheets. Due to the displaceability of the radiators, during operation of the drying device, into the vicinity of the sheets means that all ordinary or common inks and printing materials for the IR range can be dried with a minimum of cost. The simple exchange of the radiators for blowers also ensures a uniform delivery of the sheets, performance of a precise matching or adaptation of the drying device to the respective requirements and production of an additional transfer of heat to the printed surface of the sheets using the air which is needed anyway.

In accordance with a further feature of the invention, the device includes brackets combining the infrared radiators to form rows of radiators extending across the width of the sheets, the rows of radiators being liftable by the brackets out of the working position thereof, the blowers being disposed in rows above the delivery pile and being displaceable on guide rails into vicinity of the lifted infrared radiators.

In accordance with a further feature of the invention, the rows of infrared radiators are formed of individual elements and are exchangeably fastened to the brackets.

In accordance with an additional feature of the invention, the device includes scissor linkages operatively associated with the infrared radiators and the brackets thereof for lifting the radiators and the brackets.

In accordance with an added feature of the invention, the device includes means for switching the infrared radiators of the respective rows thereof on and off altogether, and the infrared radiators individually.

In accordance with yet another feature of the invention, rows of the blowers are disposed after the rows of infrared radiators in sheet-feed direction and are switchable-on individually.

Other features which are considered as characteristic for the invention are set forth in the appended claims.

Although the invention is illustrated and described herein as embodied in device for drying printed sheets on offset printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
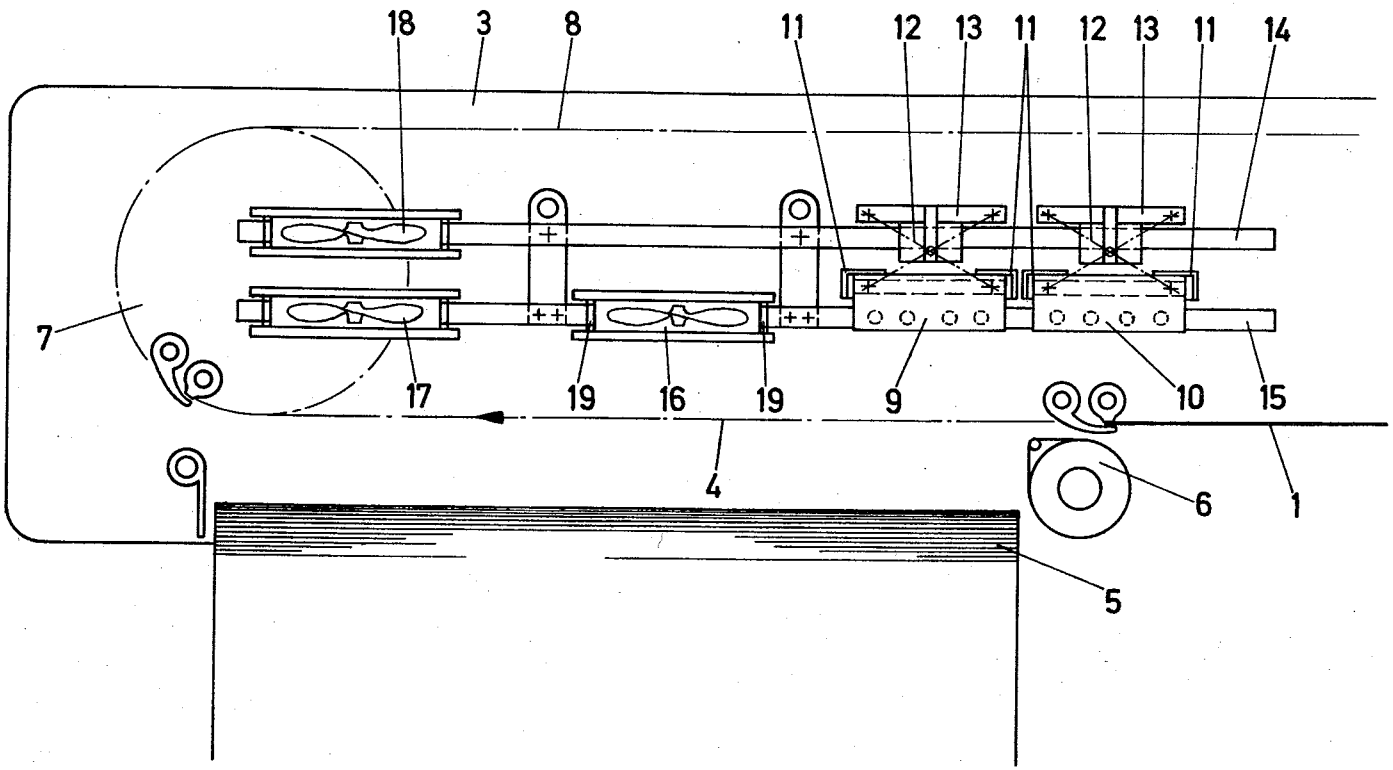
FIG. 1 is a diagrammatic side elevational view of a sheet delivery system with a drying device.

Referring now to the figures of the drawing, there is shown in FIG. 1, a sheet delivery system wherein sheets 1 are gripped by a gripper system 2 and are transported over the delivery pile 5 by a lower run 4 of delivery chains of a chain conveyor provided at opposite sides of the sheet 1 between or inside side frames 3. In order to set down the sheets 1, the grippers of the gripper system 2 open so that the sheets, braked by a conventional braking device 6, drop onto the delivery pile 5. At the end of the delivery pile, the delivery chains are reversed by sprockets 7 in a manner that an upper chain run 8 of the chain conveyor is returned again into the press.

In order for the freshly printed sheets 1 fed to the delivery pile 5 to be able to be set down without sticking, infrared radiators 19 are provided above the sheets fed by the delivery chain of the lower run 4. The infrared radiators 19 are combined by brackets 11 to form rows of radiators. The rows of radiators 19 extend across the width of the sheets 1 and are lowered by scissor linkages 12 into working position directly above the sheets and directly above the delivery pile 5, respectively.

This results in intensive drying without any great heat losses. Furthermore, the radiators 19 produce an intense action of the heat upon the printed image and upon the pile of sheets, respectively, thereby accelerating the drying speed. At the same time, the solvents released from the printing ink are removed from the sheets.

The scissor linkage 12 are fastened to guides 13 which are shiftable longitudinally to the sheet transport direction on guide rails 14 in a manner that the rows of radiators come into effect earlier or later in relation to the oncoming sheets.

Figure 2:
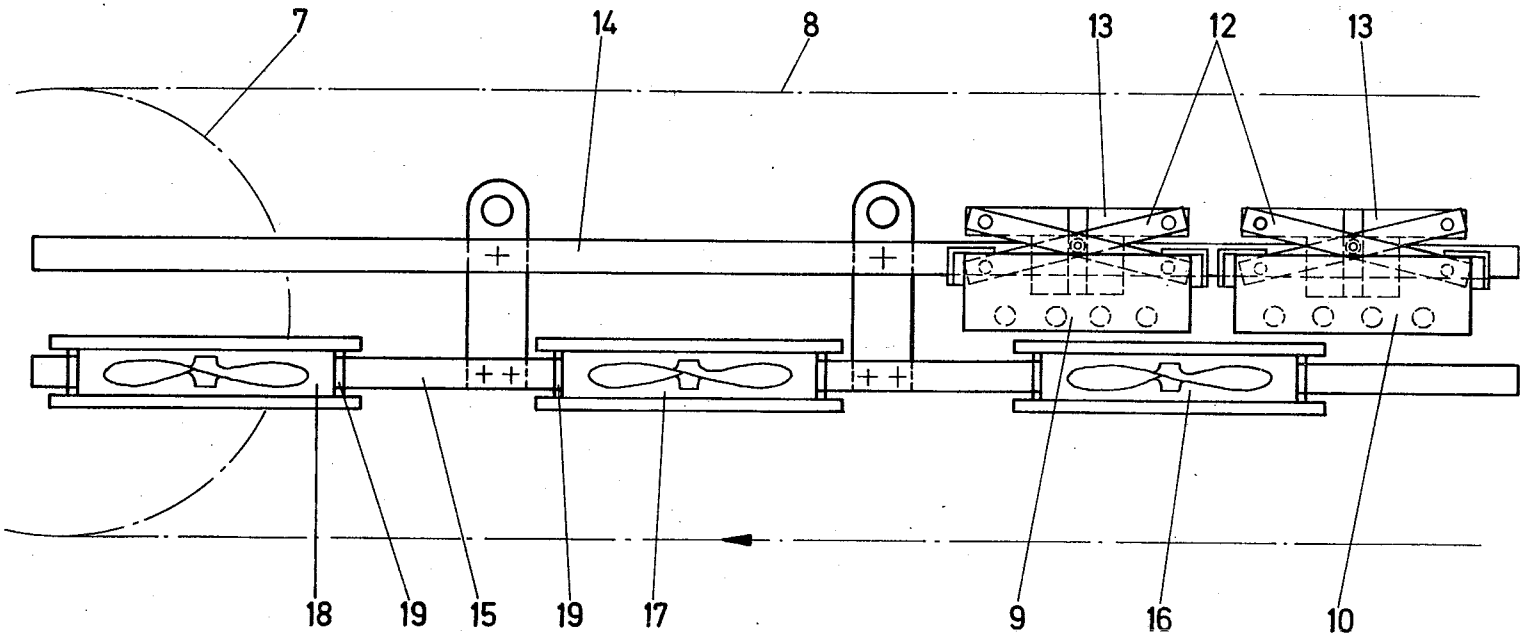
FIG. 2 is another somewhat enlarged view of FIG. 1 with the drying device in off position.

If the press is used to print a normal printing job without infrared inks, the infrared radiators are liftable out of the working position thereof by means of the scissor linkages 12 so that they free a second guide rail 15 lying therebeneath. Provided on this guide rail 15, are blowers 16, 17 and 18 which are likewise combined by rails 19 into rows of blowers. These rows of blowers also are shiftable in longitudinal direction of the press on the guide rails 15 and, in fact, as shown in FIG. 2, into the vicinity of the rows of infrared radiators. These blowers very rapidly force the released sheets 1 down onto the delivery pile 5 so that the press can be operated at high production speed. Should one of the rows of blowers, such as the row of blowers 18, not be needed for a specific printing job, it may be stuck on the guide rail 14, in standby position.

Figure 3:
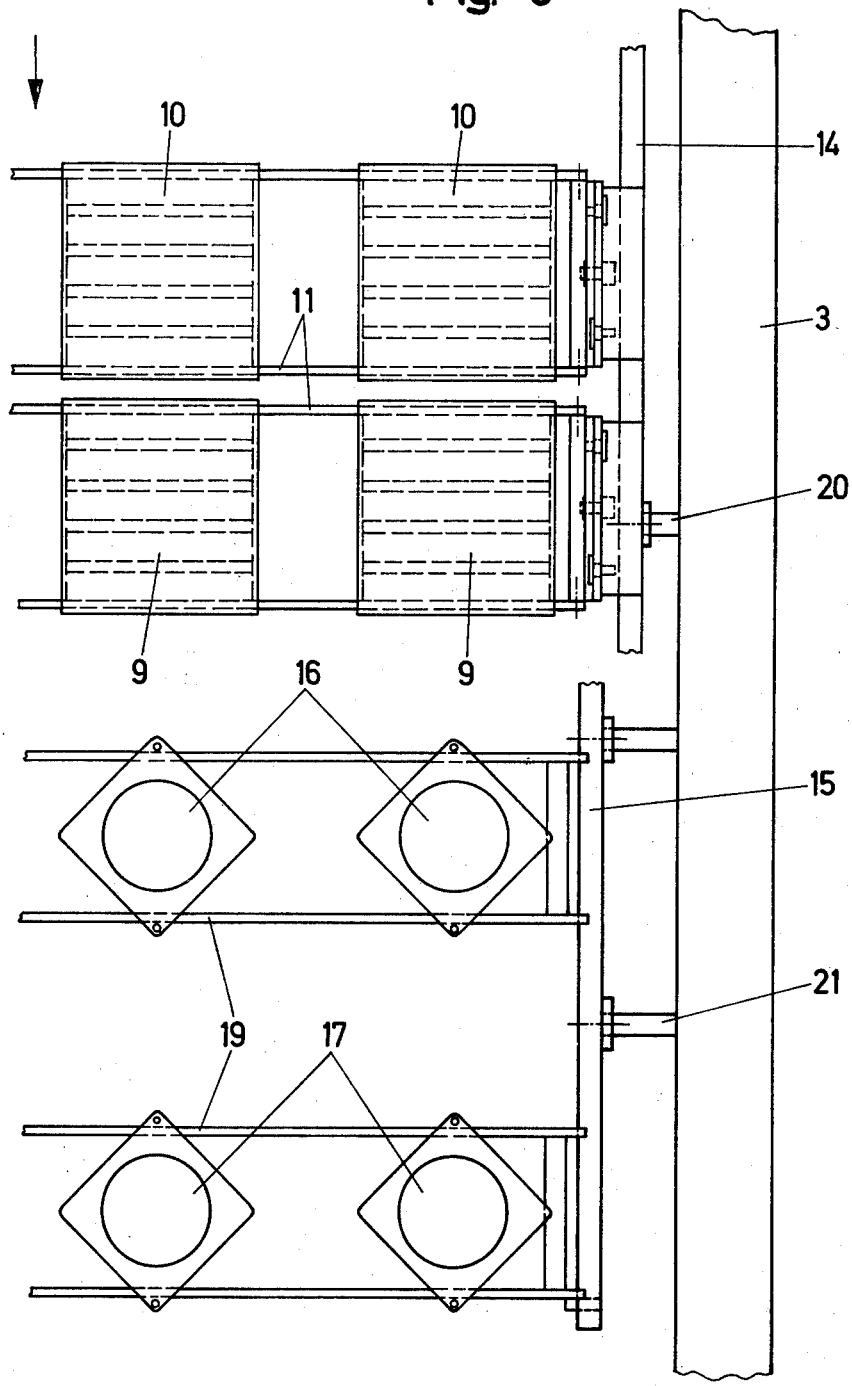
FIG. 3 is a top plan view of the drying device of FIGS. 1 and 2.

The guide rails 14 and 15 are fastened to the side frames 3 by holders 20 and 21, as shown in FIG. 3. The individual elements both of the infrared radiators 9 and 10 as well as of the blowers 16, 17 and 18 are replaceably or exchangeably fastened on brackets 11 and rails 19, respectively. The rows of infrared radiators and the rows of blowers may also be switched on and off individually. The hereinaforedescribed drying device thereby permits a simple exchange from one mode of operation to another without adversely affecting air ducting or guidance, and ensures efficient and trouble-free delivery of the individual sheets without damage to the printed image by the sticking-together of the sheets.

We claim:

1. Device for drying printed sheets on an offset printing machine, comprising infrared radiators disposed above a delivery pile of the sheets and between an upper and a lower run of an endless delivery chain, said infrared radiators being substantially vertically displaceable transversely to said upper and lower means from a rest position into a working position thereof directly above the sheets, blowers displaceable substantially horizontally and parallel to said upper and said lower runs between a rest position thereof, which is located above the delivery pile of the sheets and intermediate said upper and said lower runs, and a working position thereof coinciding with said working position of said infrared radiators, first means for displacing said infrared radiators out of said working position thereof and into said rest position thereof, and second means for displacing said blowers individually from said rest position thereof into said working position thereof after said infrared heaters have been displaced into said rest position thereof whereby said infrared radiators are replaceable by individual ones of said blowers to change the mode of operation of the device.

2. Device according to claim 1 including brackets combining said infrared radiators to form rows of radiators extending across the width of the sheets, said rows of radiators being liftable by said brackets out of said working position thereof, said second displacing means including guide rails, said blowers being disposed in rows on said guide rails and being displaceable on said guide rails into a location adjacent the lifted infrared radiators.

3. Device according to claim 2 wherein said rows of infrared radiators are formed of individual elements and are exchangeably fastened to said brackets.

4. Device according to claim 2 wherein said first means include scissor linkages operatively associated with said infrared radiators and said brackets thereof for lifting said radiators and said brackets.

5. Device according to claim 1 including means for switching the infrared radiators of the respective rows thereof on and off altogether, and said infrared radiators individually.

6. Device according to claim 1 wherein rows of the blowers are disposed after said rows of infrared radiators in sheet-feed direction and are switchable-on individually.

* * * * *